United States Patent [19]

Siegrest et al.

[11] Patent Number: 4,905,744

[45] Date of Patent: Mar. 6, 1990

[54] LIQUID-FLOW CONTROL APPARATUS

[75] Inventors: Hendrik J. G. Siegrest, Spaarndam, Netherlands; Tore Sorby, Hokksund, Norway

[73] Assignee: Elopak A/S, Norway

[21] Appl. No.: 76,673

[22] Filed: Jul. 23, 1987

[51] Int. Cl.[4] ..... B65B 3/04

[52] U.S. Cl. ..... 141/258; 141/261; 141/117; 222/372

[58] Field of Search ..... 137/614.17; 141/117, 141/115, 116, 126, 127, 258–261, 266; 222/372, 380; 417/519

[56] References Cited

U.S. PATENT DOCUMENTS

| | | | |
|---|---|---|---|
| 1,066,660 | 7/1913 | Ross | 222/380 |
| 1,077,000 | 10/1913 | Ross | 222/383 X |
| 1,815,875 | 7/1931 | Muller | 222/380 X |
| 2,014,997 | 9/1935 | Auger | 137/614.17 X |
| 2,779,506 | 1/1957 | Gajda | 141/116 X |
| 2,978,149 | 4/1961 | Rosen | 141/116 X |
| 3,982,724 | 9/1976 | Citrin | 251/7 |
| 4,030,640 | 6/1977 | Citrin et al. | 141/117 X |
| 4,230,160 | 10/1980 | Buckley | 141/116 |
| 4,254,806 | 3/1981 | Elsworth | 141/116 |
| 4,478,412 | 10/1984 | Muir | 137/614.17 X |
| 4,569,378 | 2/1986 | Bergandy | 141/266 |
| 4,674,547 | 6/1987 | Simonazzi | 141/266 X |

FOREIGN PATENT DOCUMENTS

| | | |
|---|---|---|
| 138234 | 4/1985 | European Pat. Off. . |
| 0234102 | 9/1987 | European Pat. Off. . |

*Primary Examiner*—Ernest G. Cusick

*Attorney, Agent, or Firm*—Pravel, Gambrell, Hewitt, Kimball & Krieger

[57] ABSTRACT

A dosing device for filling liquid into containers comprises a filler body and a metering device. The metering device communicates with the interior of a rotary valve through an end cover of the valve housing, the valve including a valve seat and a check valve closure member spring-biased towards the seat. The valve includes first, second and third rotary ports and first and second fixed ports. Downstream of the second fixed port is an anti-drip suction-producing device of a piston-and-cylinder form whereof the stroke of the piston is adjustable. Upstream of the first fixed port is a throttling valve lowerable into an operative position downstream of inlet holes from a liquid-containing tank. For a high viscosity liquid, it is drawn into the metering device through the holes, the first fixed and rotary ports and the end cover, the rotary valve is rotated to align the second rotary port with the second fixed port and to close the first fixed port, and the liquid is then expelled from the metering device through the end cover, the second rotary and fixed ports and an outlet nozzle. A low viscosity liquid is drawn into the metering device through the holes, the lowered throttling valve, the first fixed and rotary ports and the end cover, and is then expelled from the metering device through the end cover, and check valve, the third rotary port and the second fixed port and the nozzle.

9 Claims, 4 Drawing Sheets

LIQUID-FLOW CONTROL APPARATUS

BACKGROUND OF THE INVENTION

1. Field of the Invention

The present invention relates to apparatus for controlling liquid flow, for example to a dosing apparatus for filling liquids into containers.

2. Description of the Prior Art

U.S. Pat. No. 2,399,300 discloses a filling apparatus including a supply line and a valve therein responsive to pressure in the line for shutting off the line when the line pressure falls below a certain minimum. The supply line leads from a source of liquid to a rotary filler tank equipped with filler heads. A regulatable source of vacuum is connected through a pipe and a swivel joint into the top of the tank. The valve comprises a casing formed with a conical seat with which diametrically opposed, fixed, inlet and outlet ports are in communication. A valve plug cooperating with the seat is equipped with an operating handle. The plug has a diametric passage including an enlarged middle section. At one end the enlargement is formed as a seat with which is co-operable a valve closure member of a check valve mounted in the enlargement. The closure member is equipped with a stem which is guided in a spider at the opposite end of the enlargement from the closure member. A compression spring encircling the stem and interposed between the spider and the valve closure member acts to seat the latter. Of the two side walls of the plug between the closure member and the spider, one is solid, whereas the other is formed with an opening communicating with immediately downstream of the closure member. Depending upon the position of the plug as set using the handle, the one side wall positively cuts off the supply line; or the check valve is placed in control of flow through the supply line; or the opening communicates with the fixed inlet port, so that the check valve is by-passed and the supply line is drained into the tank. When the check valve is in control, it serves to differentiate between fluids of different specific gravity; for example between milk and air. The vacuum effect is of itself incapable of unseating the check valve, such action being possible only as a result of the total pressure of the liquid acting on the check valve.

U.S. Pat. No. 4,254,806 discloses an apparatus for filling caulking tubes in a clean manner with a liquid viscous composition, wherein to a nozzle from which the composition passes into the tube there is connected a suck-back means comprising a first piston-and-cylinder device which retracts away from the nozzle when composition is not being forced into the tube, so as to create suction upon the composition in the nozzle and thus prevent it leaking from the nozzle. The first piston-and-cylinder device is operable via a four-way valve via which is also operable a second piston-and-cylinder device which turns a rotary valve having first, second and third fixed ports and first and second rotary ports. The first fixed port is an inlet for the caulking composition, the second fixed port communicates with a metering piston-and-cylinder device for the composition and the third fixed port is an outlet to the nozzle. The rotary valve is a two-position valve in one position of which the inlet port is connected via the rotary ports with the second fixed port and in the other position of which the second fixed port is connected via the rotary ports with the outlet port. This apparatus is not suitable for handling fluids of differing characteristics, particularly viscosities. Firstly, the resistance to fluid flow of the path from the metering cylinder to the nozzle outlet is the same irrespective of the viscosity of the fluid. Secondly, the stroke of the suck-back means is not adjustable in order to adjust the vacuum produced thereby to the fluid to be filled.

The apparatus disclosed in European Patent Specification No. 0138234 has been designed with a view to coping with filling liquids of differing viscosities. It comprises a filler tank from which extend downwards filler heads connected by branch conduits to respective metering cylinders and terminating in outlet nozzles. Two kinds of outlet nozzles are selectively mountable at the end of each filler head; one for high viscosity liquid and the other for low viscosity liquid. The high-viscosity liquid nozzle comprises a tubular nozzle main body attachable to the filler head, a damper pivoted to the lower end of that body, a damper opening rod vertically movably supported by that body, and a spring for biasing the rod upward. The low viscosity liquid nozzle comprises a tubular nozzle main body, a lower check valve in the upper end of that body, and a metal net disposed in the lower end of that body. Not only are these two nozzles rather complicated, but also the changing of them is time-consuming.

SUMMARY OF THE INVENTION

According to one aspect of the present invention, there is provided apparatus for controlling liquid flow, comprising duct means, a metering device, and a rotary valve interposed in said duct means and including a fixed inlet port and a fixed outlet port arranged at an angular interval from each other, first and second rotatable ports arranged at said interval from each other, and a further port via which said metering device communicates with the rotary valve and via which said metering device can receive a desired amount of liquid through said fixed inlet port and said first rotatable port and can emit said amount through said second rotatable port and said fixed outlet port, wherein the improvement comprises a check valve carried by said rotary valve and arranged to close said second rotatable port.

Owing to this aspect of the invention, it is possible to provide apparatus which smoothly and efficiently controls the flow of high viscosity liquids as well as low viscosity liquids.

According to another aspect of the present invention, there is provided dosing apparatus for emitting liquid doses, comprising an outlet chamber, means for supplying doses of liquid to said chamber and including an inlet valve to said chamber, outlet means from said chamber, and a suction-producing device communicating with said chamber at a location downstream of said inlet valve and upstream of said outlet means and arranged to produce suction in said chamber, said device including a wall portion of said chamber movable inwardly and outwardly to reduce and increase, respectively, the internal volume of said chamber, wherein the improvement comprises adjusting means for adjusting the stroke of said wall portion.

In this way, it is possible to adjust the maximum vacuum produced in the chamber, in order to adjust for differing materials being filled.

BRIEF DESCRIPTION OF THE DRAWINGS

In order that the invention may be clearly understood and readily carried into effect, reference will now be made, by way of example, to the accompanying drawings, in which.

DESCRIPTION OF THE PREFERRED EMBODIMENTS

Figure 1:
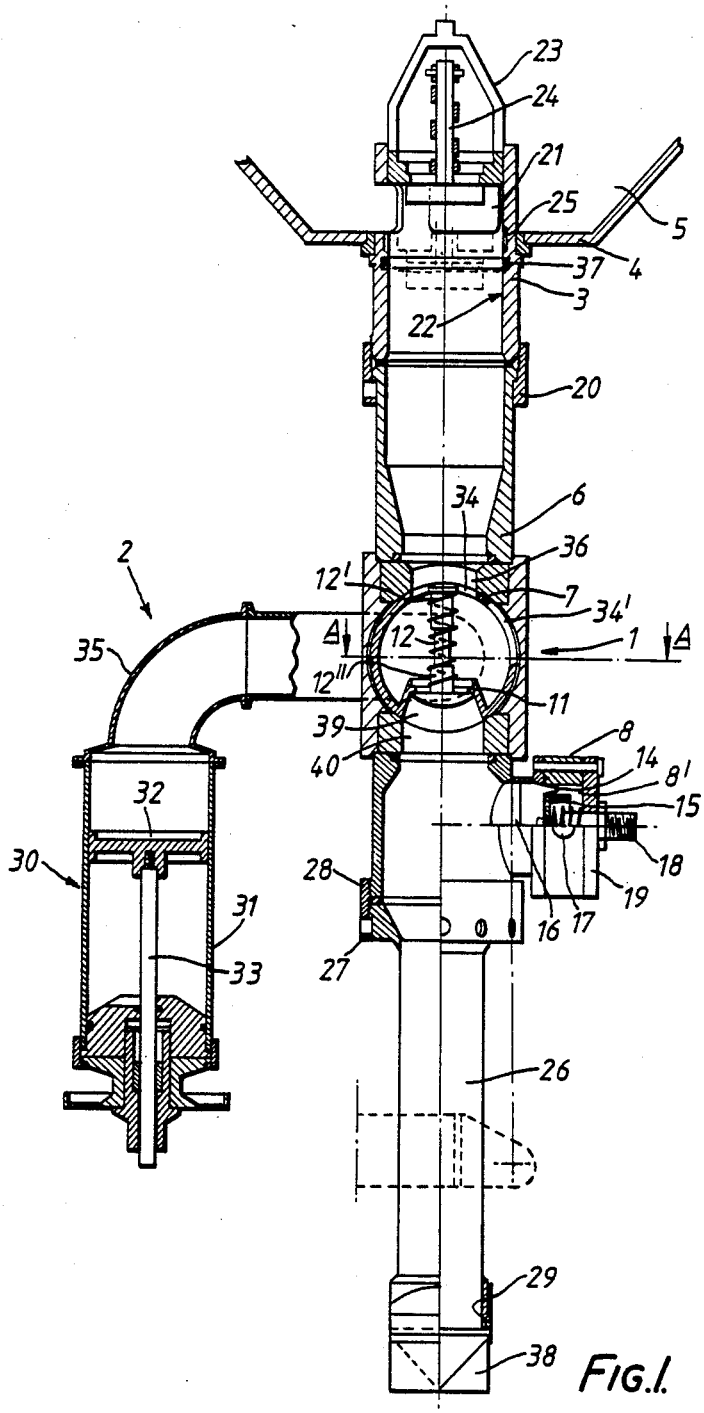
FIG. 1 shows a view, mainly in vertical section, of a dosing apparatus for filling liquid into containers
Figure 2:
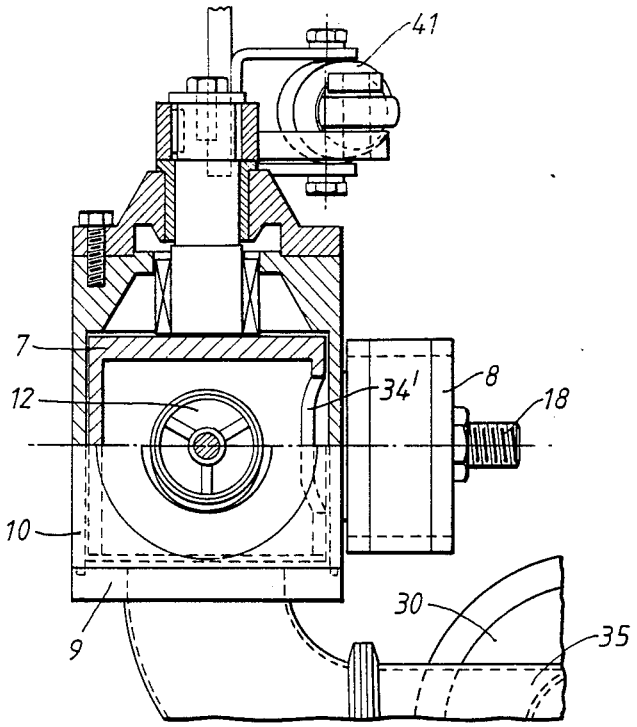
FIG. 2 shows a view which is mainly a horizontal section taken on the line A—A of FIG. 1, FIGS. 3 and 4 are respective views similar to FIG. 1, but diagrammatic and illustrating the apparatus during high viscosity liquid prefilling and filling stages, respectively.

Referring to the drawings, the apparatus comprises a filler body 1 and a metering device 2, the filler body 1 having an upper portion 3 extending through and projecting upwards beyond the bottom wall 4 of a liquid tank 5 and communicating with the tank 5, and an intermediate portion 6 fixed to the upper portion 3 by a threaded nut 20, and a suction-producing device 8. The metering device 2 communicates via a tube 35 with a rotary valve 7 through an end cover 9 of the rotary valve housing 10, the rotary valve 7 including an internal built-in valve seat 11 and a check valve closure member 12 urged towards the valve seat 11 by a helical tension spring 12', a bushing on the valve stem 12'' limiting the downward stroke of the member 12. The rotary valve is rotatable through 113° by an air cylinder 41 or a mechanical drive, itself controlled by a timer, and includes three rotary ports 34, 34' and 39 arranged at intervals of 67° between the ports 34 and 34' and of 113° between the ports 34' and 39, and two fixed ports 36 and 40 at 180° intervals. The device 8 fixed to a lower cylindrical part of the intermediate portion 6 and includes a vacuum chamber 8' separated from the interior of the filler body 1 by a roll membrane 14 and connected to a vacuum pump (not shown), a membrane piston 15 being pressed towards a stop pin 16 by a spring 17 when the chamber 8' is not under vacuum, and the length of stroke being adjustable by a screw 18 centrally threaded in a vacuum chamber cover 19 of the device 8. The negative pressure in the chamber 8' can be adjusted with a bleeder nozzle (not shown).

The upper portion 3 has inlet openings 21 for high viscosity liquid. Below the openings is an O-ring 37 mounted in an annular groove in the inner surface 22 of the portion 3.

An inlet piston 23 has, for low viscosity liquid, an inlet check valve 24 built-in and constituting liquid-flow throttling means. When the filler is used for low viscosity liquid the piston 23 is lowered axially in the portion 3 to seal against the O-ring 37. The piston 23 is operated by an air cylinder not shown in FIG. 1.

The piston 23 has to be lifted by the air cylinder to release trapped air from the body 1. Vertical grooves 25 are made in the surface 22 to allow the escape of surplus liquid when the piston is lowered.

The lower portion of the filler body 1 comprises a tubular part 26 which is attached to the intermediate portion 6 by means of a fastening nut 27 screwed on a threaded end 28 of the portion 6. A flexible nozzle 38 is mounted in a groove 29 on the lower end zone of the tubular part 26. The nozzle is made of a resilient material and has outlet lips which are pressed sealingly together by the resilience of the material.

The metering device comprises a metering cylinder 30 comprised of a cylindrical body 31, a piston 32 and a piston rod 33.

The interior of the filler body 1 constitutes a duct in which the rotary valve 7 is interposed. The portion of the duct between the valve 7 and the nozzle 38 constitutes an outlet chamber.

Operating the filler for high viscosity liquid filling

Figure 3:
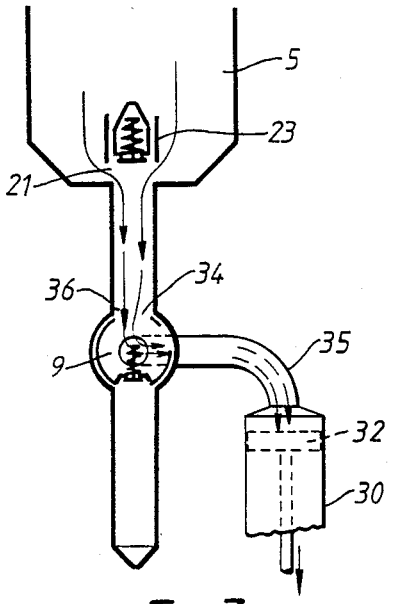
Figure 4:
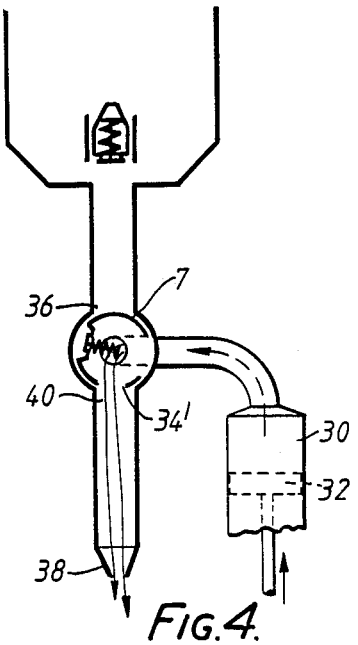

With the piston 23 permanently in its upper position, the downward stroke of the piston 32 in the metering cylinder 30 permits liquid to flow into the cylinder from the tank 5 through the openings 21, 36 and 34 and the end cover 9 and the tube 35 (FIG. 3). When the downward stroke is completed, the rotary valve 7 is turned through 113° by means of the air cylinder 41 or mechanical device to close the port 36 and open the ports 34' and 40 to the nozzle 38. When the metering piston 32 moves upward the liquid flows from the metering cylinder 30 to the nozzle 38 and into a container to be filled (FIG. 4).

As the metering piston 32 reaches its top position the rotary valve 7 turns back 113°. When the port 40 is closed, the vacuum chamber 8' is immediately evacuated and a negative pressure is created in the part 26.

Operating the filler for low viscosity liquid filling

Figure 5:
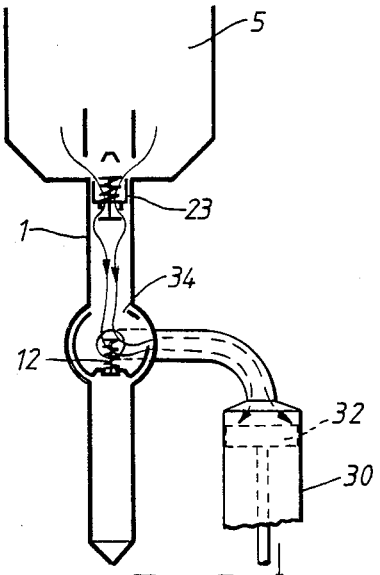
FIGS. 5 and 6 are respective views similar to FIGS. 3 and 4, but during low viscosity liquid prefilling and filling stages, respectively.
Figure 6:
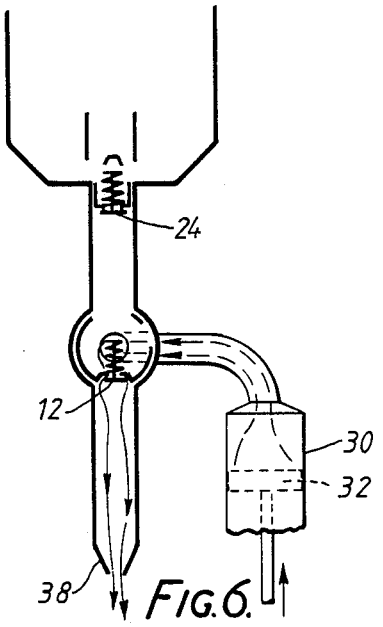

With the port 34 open, the metering cylinder 30 is filled by a downward stroke of the piston 32. The piston 23 is in its top position to release air. When the filling starts, the piston 23 is moved downwards to seal against the O-ring 37. Surplus liquid in the filler body 1 will then partly escape to the tank 5 through the grooves 25 and partly be pressed out through the check valve 12 (FIG. 5). When the piston 32 is moved upwards the check valve 24 closes and the check valve 12 opens and liquid is discharged through the nozzle 38 (FIG. 6).

When the piston 32 ends its upward stroke the spring-loaded check valve 12 closes.

If the check valve 12 does not create the necessary negative pressure in the nozzle 38, the device 8 is operated by an external vacuum control valve (not shown).

The dosing apparatus described above has an advantage that it can be changed between handling low viscosity liquid and handling high viscosity liquid by simply raising or lowering the piston 23 and by simply rendering operative or inoperative the rotary valve 7, so that it is not necessary to dismantle and change any part of the apparatus. Another advantage is that the vacuum in the chamber 8' can be readily adjusted without interrupting production.

Figure 7:
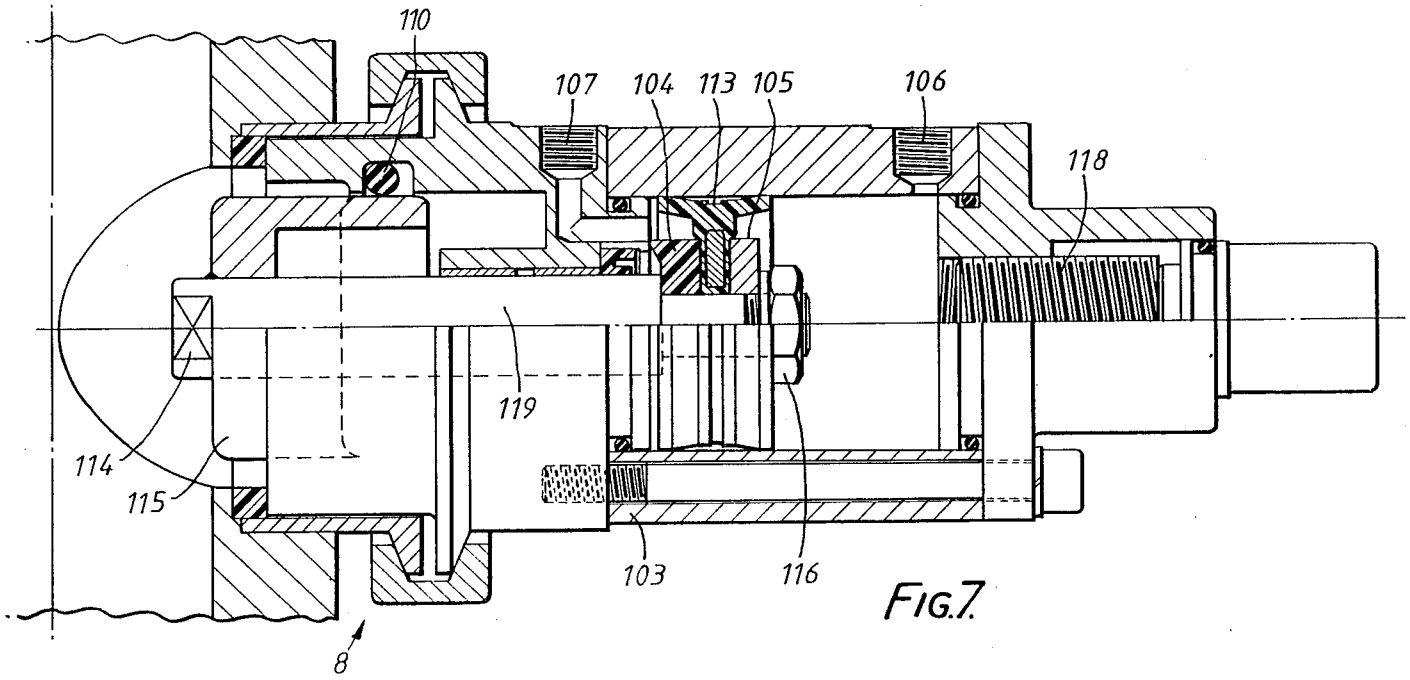
FIG. 7 shows two half-views of a modification of the apparatus, an upper half-view being substantially a vertical section, and the lower half-view being a sectional side elevation.

In the modification shown in FIG. 7, the membrane piston 15 of the device 8 has been replaced by a piston 115 sealingly encircled by an O-ring 110 housed in an annular internal groove in a cylinder 103. The piston 115 includes a central rod 119 on which is held by a nut 116 a piston ring 113 between two clamping rings 104 and 105. The piston 115 is double-acting, compressed air being introduced alternately through ports 106 and 107 at respective opposite sides of the piston ring 113. A set screw 118 screwed axially into the outer end of the cylinder 103 adjustably sets the stroke of the piston and thus the magnitude of the suction produced in the chamber between the valve 7 and the nozzle 38. A boss or a hole 114 for an Allen key or the like is formed in that end of the piston 115 bounding the latter chamber, to permit tightening of the nut 116 without the need to dismantle the device 8.

We claim:

1. Apparatus for controlling liquid flow, comprising a duct, a metering device, and a rotary valve interposed in said duct and including a fixed inlet port and a fixed outlet port arranged at an angular interval from each other, first and second rotatable ports arranged at said interval from each other, and a further port via which said metering device communicates with the rotary valve and via which said metering device can receive a desired amount of liquid through said fixed inlet port and said first rotatable port and can emit said amount through said second rotatable port and said fixed outlet port, wherein the improvement comprises a check valve carried by said rotary valve and arranged to close said second rotatable port.

2. Apparatus according to claim 1, wherein said rotary valve comprises a third rotatable port which can be brought, by rotation of said rotary valve, to a position substantially aligned with said fixed outlet port, wherein said metering device can selectively emit said amount of liquid through said third rotatable port and said fixed outlet port, alternatively to emitting said amount of liquid through said second rotatable port and said fixed outlet port.

3. Apparatus according to claim 1, and further comprising liquid-flow throttling means arranged upstream of said fixed inlet port.

4. Apparatus according to claim 3, wherein said liquid-flow throttling means is displaceable between an inoperative position in which it is unable to throttle liquid flowing towards said fixed inlet port and an operative position in which it throttles liquid flowing towards said fixed inlet port.

5. Apparatus according to claim 1 and further comprising an outlet chamber downstream of said fixed outlet port, a dispensing outlet from said chamber, and a suction-producing device communicating with said chamber at a location downstream of said fixed outlet port and upstream of said dispensing outlet and arranged to produce suction in said chamber.

6. Apparatus according to claim 5, wherein said suction-producing device includes a wall portion of said chamber movable inwardly and outwardly to reduce and increase, respectively, the internal volume of said chamber, and adjusting means for adjusting the stroke of said wall portion.

7. Apparatus according to claim 6, wherein said suction-producing device comprises a piston-and-cylinder device, and said adjusting means comprises a set screw arranged to abut the piston of said piston-and-cylinder device.

8. Apparatus for emitting doses of liquid, comprising:

an outlet chamber;

pumping means upstream of said outlet chamber for injecting a dose of liquid into said outlet chamber and including an inlet valve of said outlet chamber;

a dispensing outlet of said outlet chamber;

a suction producing device connected to said outlet chamber downstream of said inlet valve and upstream of said dispensing outlet, said suction producing device being arranged to produce a suction in said outlet chamber and including a wall portion of said outlet chamber movable inwardly and outwardly to respectively reduce and increase the internal volume of said chamber; and adjusting means for adjustably setting the magnitude of inward and outward movement of said wall portion.

9. Apparatus according to claim 8, wherein:

said suction producing device comprises a piston and a cylinder, said piston being within said cylinder; and said adjusting means comprises a set screw arranged to abut said piston so as to adjustably limit the travel of said piston within said cylinder.

* * * * *